US005735428A

United States Patent [19]

Chern

[11] Patent Number: 5,735,428

[45] Date of Patent: Apr. 7, 1998

[54] SEALING CONTAINER

[76] Inventor: Yuh Shun Chern, 3F, No. 54, Lane 27 Sanho Road, Sec. 4, Sanchung, Taipei, Taiwan

[21] Appl. No.: 827,824

[22] Filed: Apr. 10, 1997

[51] Int. Cl.[6] ..... B65D 51/16; E05C 5/02

[52] U.S. Cl. ..... 220/324; 190/120; 292/114; 292/103

[58] Field of Search ..... 220/315, 324, 220/326; 190/119, 120, 121; 36/50.5; 292/114, 101, 103, 256, DIG. 30, 113; 24/70 SK, 69 SK

[56] References Cited

U.S. PATENT DOCUMENTS

| | | | |
|---|---|---|---|
| 4,232,890 | 11/1980 | Hoen | 292/114 |
| 4,834,434 | 5/1989 | Moore | 220/324 X |
| 4,856,210 | 8/1989 | Delery | 36/50.5 X |
| 5,127,684 | 7/1992 | Klotz et al. | 292/113 |
| 5,383,258 | 1/1995 | Nicoletti | 24/70 SK |
| 5,385,257 | 1/1995 | Hung | 220/324 |

FOREIGN PATENT DOCUMENTS

| | | | |
|---|---|---|---|
| 261245 | 8/1949 | Switzerland | 292/114 |

*Primary Examiner*—Allan N. Shoap
*Assistant Examiner*—Nathan Newhouse
*Attorney, Agent, or Firm*—Pro-Techtor International

[57] ABSTRACT

A sealing container including a hooked lever turned about a pivot pin between two lugs at the periphery of a container body near its top and adapted to hold down a sealing cap being pivoted to the container body, wherein the lugs of the container body have each a through hole in which the pivot pin is moved, and a springy, smoothly curved projecting portion projecting into the through hole, the through hole of each lug defining a vertical sliding portion at the top, a transverse retaining portion at the bottom, and an arched intermediate portion communicating between the vertical sliding portion and the transverse retaining portion corresponding to the springy, smoothly curved projecting portion.

1 Claim, 9 Drawing Sheets

SEALING CONTAINER

BACKGROUND OF THE INVENTION

The present invention relates to sealing containers, and more particularly to the locking mechanism of a sealing container which has a simple structure and is inexpensive to manufacture.

A regular sealing container, as shown in FIG. 1, comprises a container body 10 having a mounting groove 101 around the periphery near its top side, a binding ring 102 mounted on the mounting groove 101 around the container body 10, a sealing cap 20 mounted with a sealing rubber 201 and having a mounting groove 202 around the periphery, and a binding wire 203 mounted on the mounting groove 202 around the sealing cap 20. The binding ring 102 is fastened with a frame 103 having two lugs 1021. A lever 1023 is pivoted to the binding ring 102 opposite to the frame 103. A hanger 1022 is pivoted to the lever 1023. The binding wire 203 has a retainer portion 2031 in the middle, and two curved ends 204 respectively and pivotably connected to the lugs 1021. When the sealing cap 20 is closed on the container body 10, the hanger 1022 is hung on the retainer portion 2031 of the binding wire 203, and then the lever 1023 is turned downwardly inwards to pull down the hanger 1022. This structure of sealing container is functional, however its complicated structure greatly complicates its assembly procedure and its manufacturing cost. FIGS. 3, 4 and 5 show another structure of sealing container according to the prior art. This structure of sealing container comprises a container body 30 having a pair of first lugs 301 at one side and a second lug 302 with a pivot hole 3021 at an opposite side, a sealing cap 40 having a barrel 401 at one side pivotably connected between the first lugs 301 and a hook 402 at an opposite side, a lever 50 pivoted to the pivot hole 3021 of the second lug 302, and a hook plate 60 pivoted to the lever 50 and having a hooked portion 601 adapted for be forced into engagement with the hook 402 of the sealing cap 40. This locking mechanism of this structure of sealing container is still complicated.

SUMMARY OF THE INVENTION

It is the main object of the present invention to provide a locking mechanism for a sealing container for locking its sealing cap which is simple in structure and inexpensive to manufacture. According to the preferred embodiment of the present invention, the sealing container comprises a container body having a pair of lugs, a sealing cap pivoted to the container body and having a retainer block at the periphery corresponding to the lugs of the container body, a pivot pin coupled between the lugs of the container body, and a lever turned about the pivot pin and having a hooked top end adapted to be forced into engagement with the retainer block to hold down the sealing cap, wherein the lugs of the container body have each a through hole in which the pivot pin is moved, and a springy, smoothly curved projecting portion projecting into the through hole, the through hole of each lug defining a vertical sliding portion at the top, a transverse retaining portion at the bottom, and an arched intermediate portion communicating between the vertical sliding portion and the transverse retaining portion corresponding to the springy, smoothly curved projecting portion. When the pivot pin is moved from the transverse retaining portion into the vertical sliding portion, the lever is allowed to be turned about the pivot pin to force its hooked top end into or out of engagement with the retainer block of the sealing cap.

DETAILED DESCRIPTION OF THE PREFERRED EMBODIMENT

Figure 1:
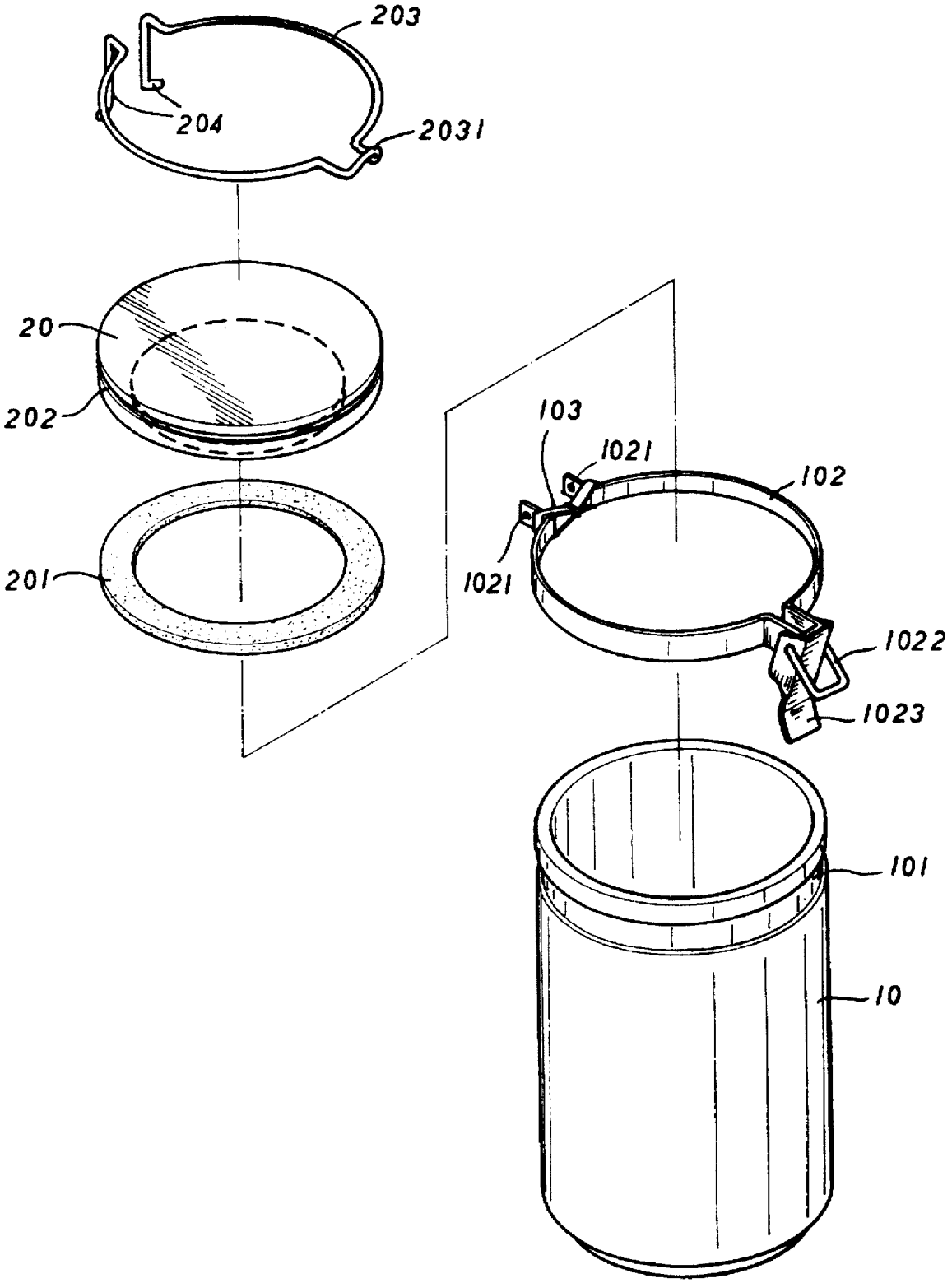
FIG. 1 (Prior Art)
FIG. 1 is an exploded view of a sealing container according to the prior art.
Figure 2:
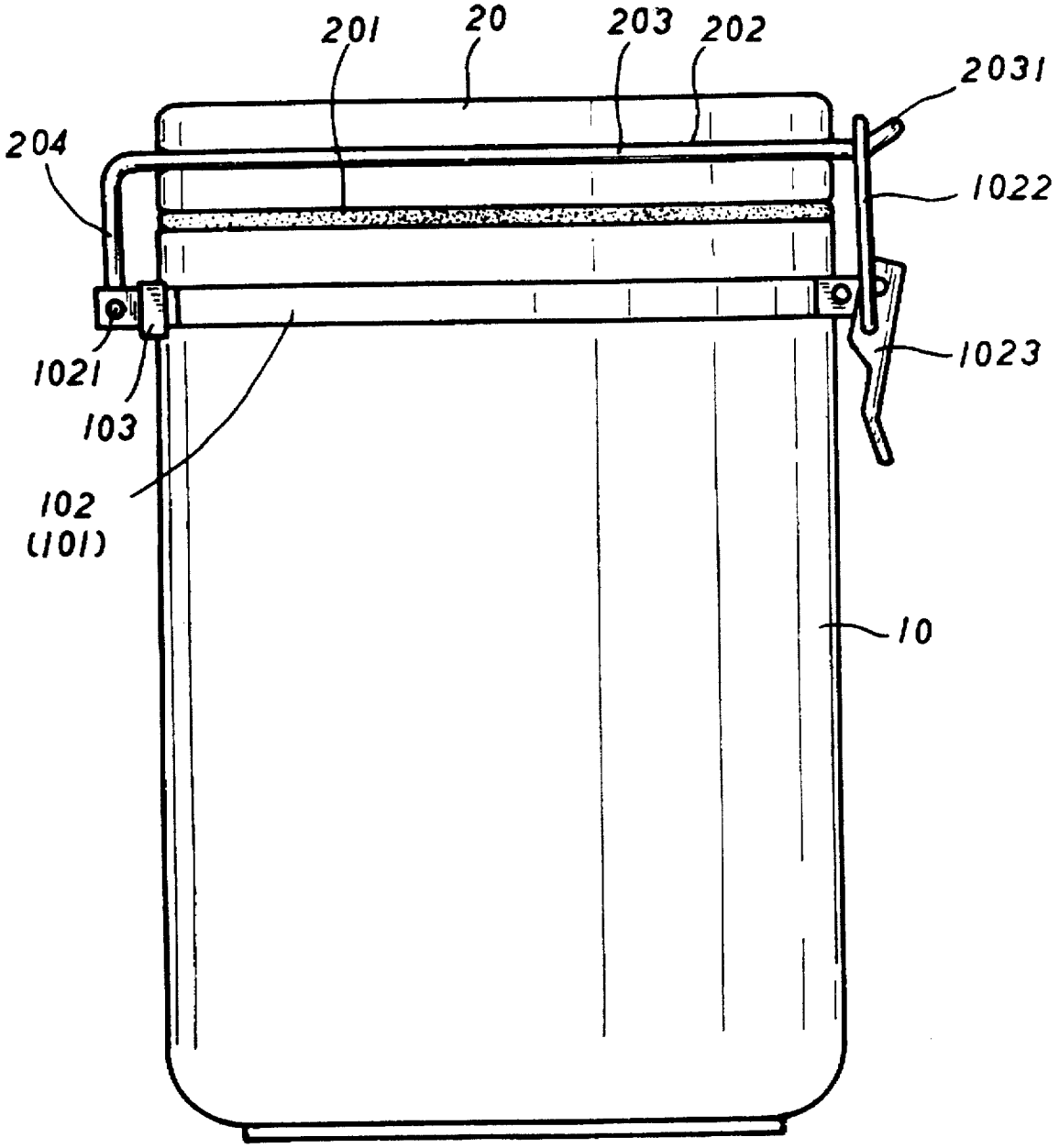
FIG.2 (Prior Art)
FIG. 2 is a side view of the sealing container shown in FIG. 1.
Figure 3:
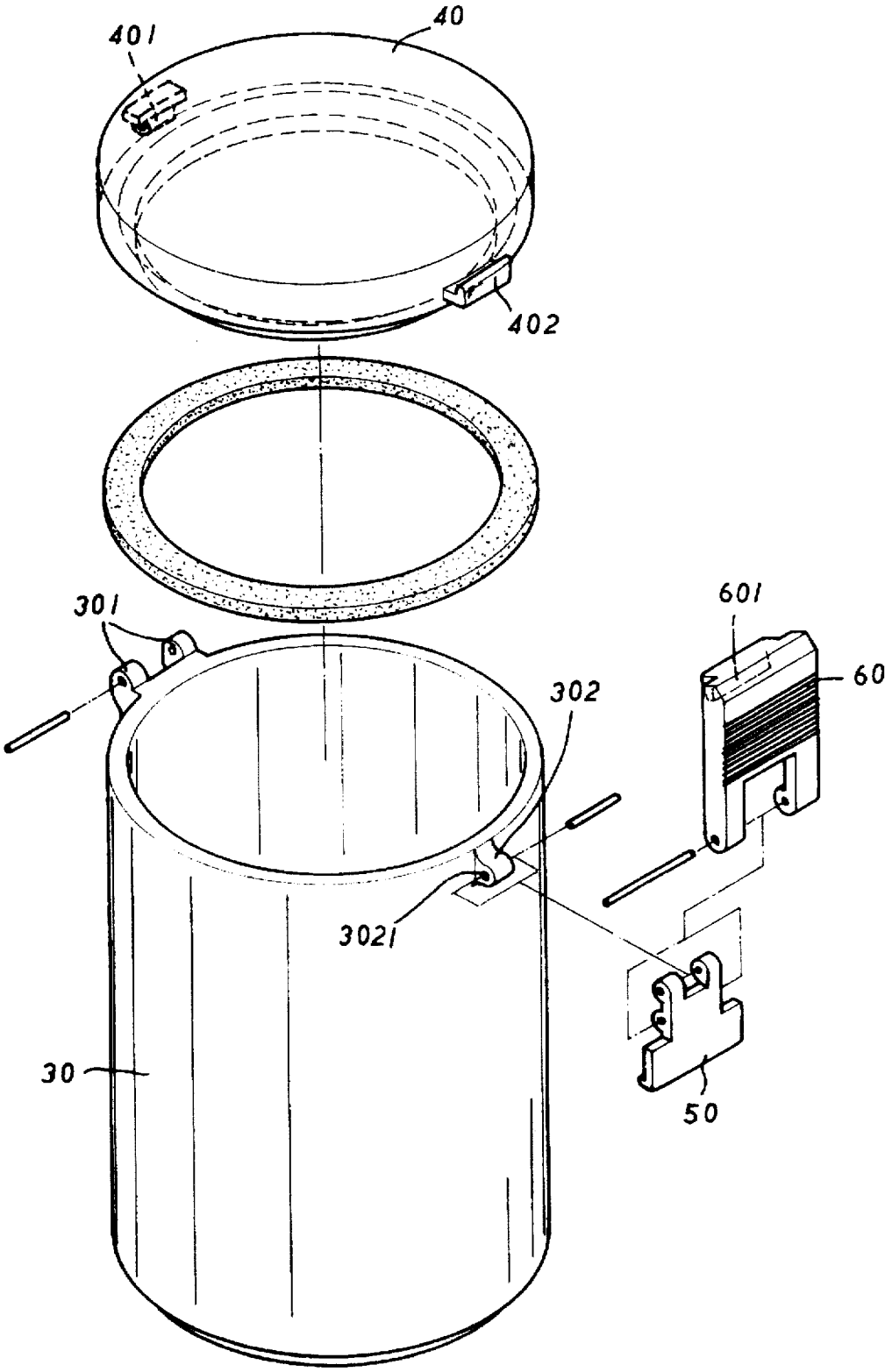
FIG. 3 (Prior Art)
FIG. 3 is an exploded view of another structure of sealing container according to the prior art.
Figure 4:
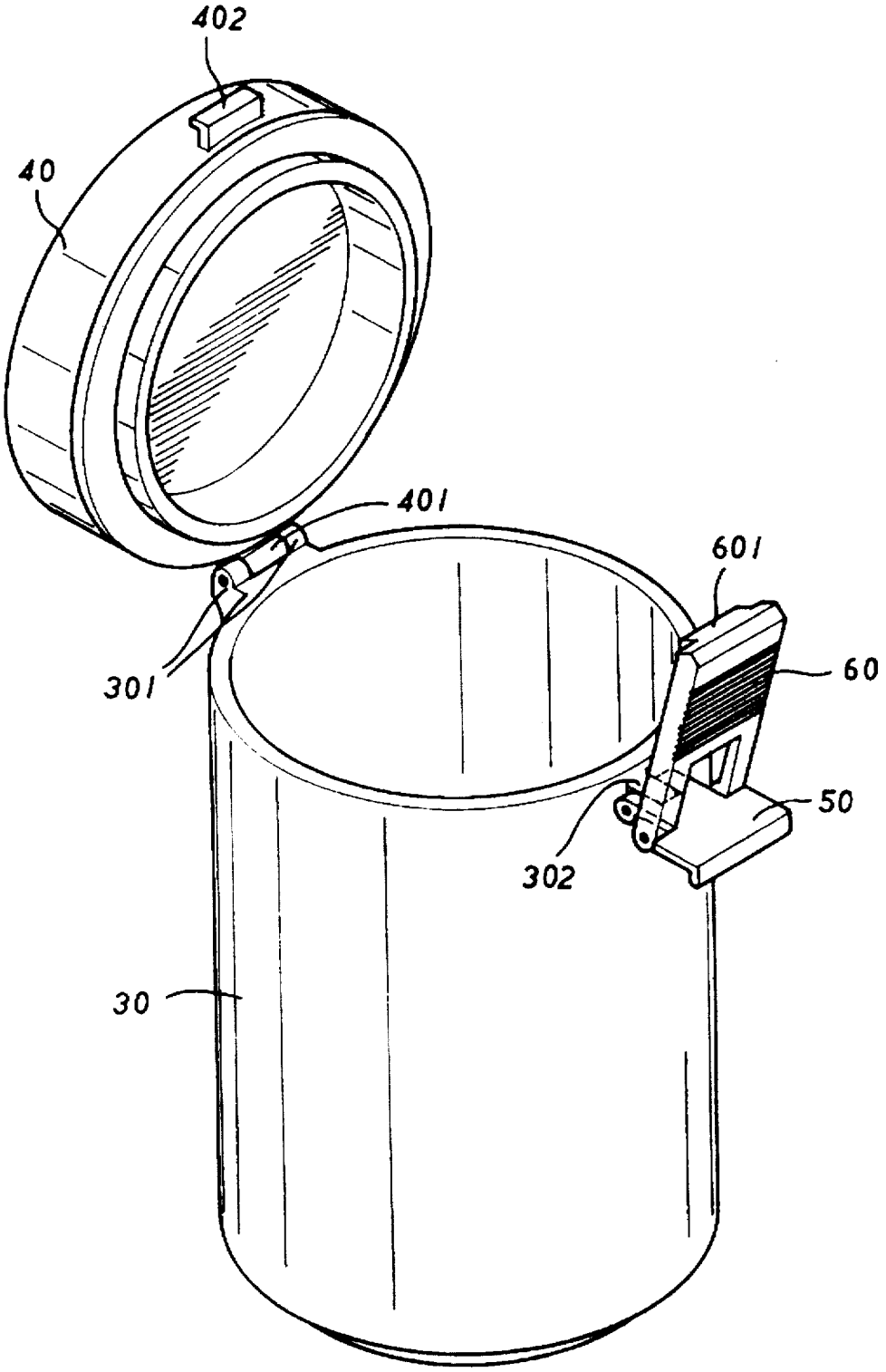
FIG. 4 (Prior Art)
FIG. 4 is an assembly view of the sealing container shown in FIG. 3, showing the Sealing cap opened.
Figure 5:
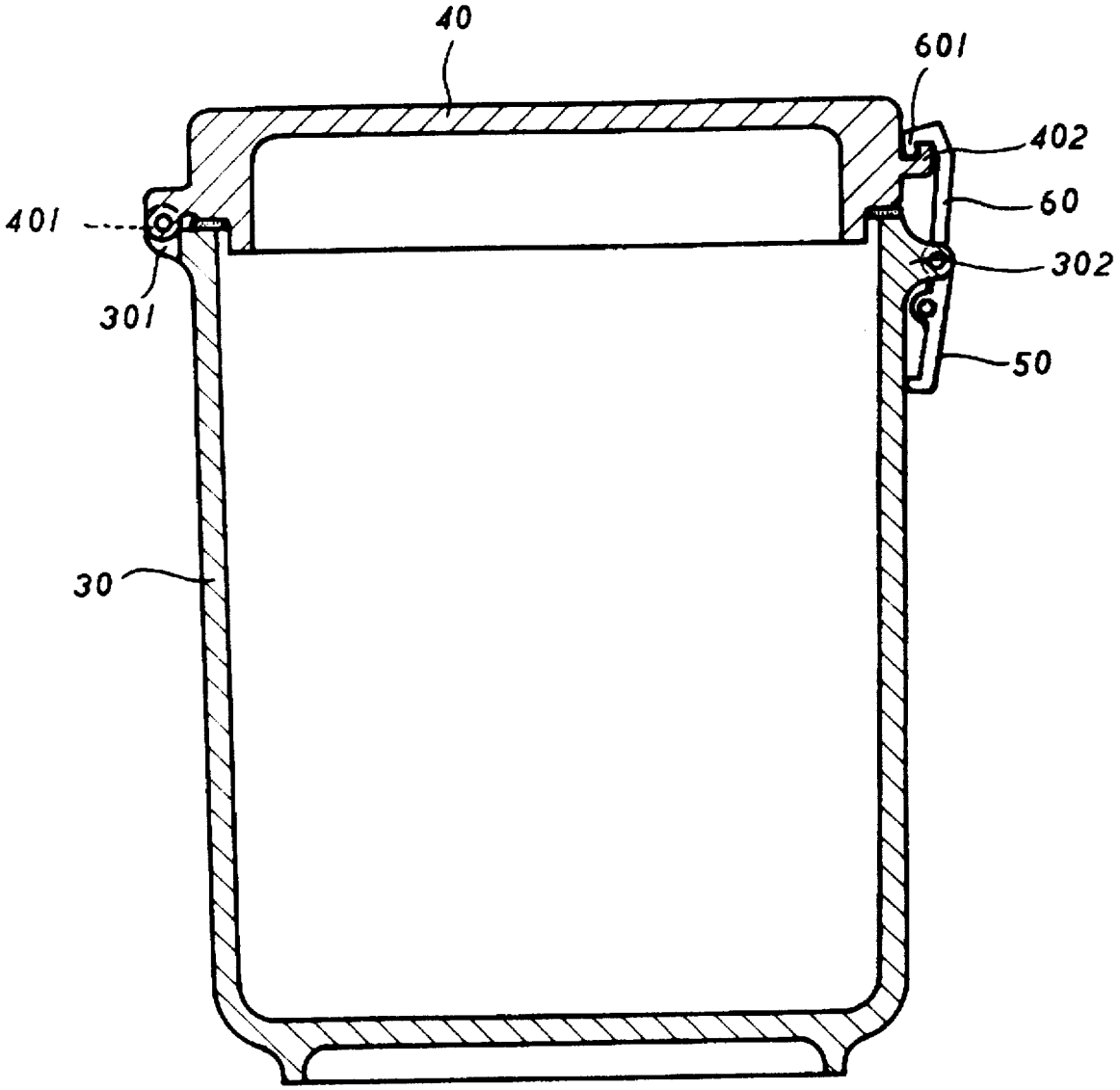
FIG.5 (Prior Art)
FIG. 5 is a side view in section of the sealing container shown in FIG. 4, showing the sealing cap closed.
Figure 6:
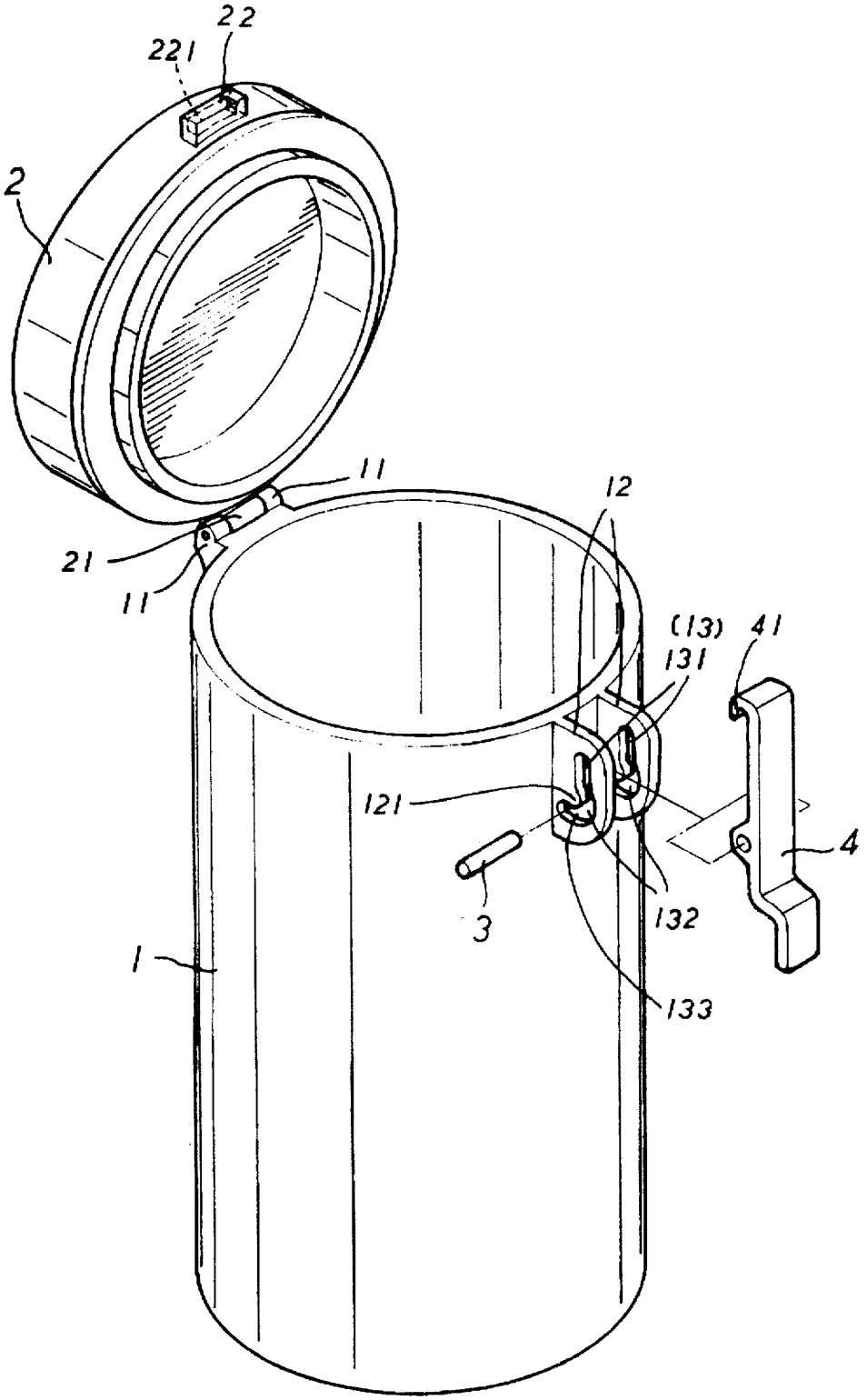
FIG. 6 is an exploded view of a sealing container according to the present invention.

Referring to FIG. 6, the container body, referenced by 1, comprises a first pair of lugs 11 and a second pair of lugs 12 respectively raised from the periphery at two opposite sides near its top side. The second pair of lugs 12 comprise each a through hole 13 and a springy, smoothly curved projecting portion 121 projecting into the through hole 13. The through hole 13 is comprised of a vertical sliding portion 131 at the top, a transverse retaining portion 133 at the bottom, and an arched intermediate portion 132 connected between the vertical sliding portion 131 and the transverse retaining portion 133. The sealing cap, referenced by 2, comprises a pivot pin 21 disposed at the periphery near its bottom side and pivotably coupled to the first pair of lugs 11 of the container body 1, and a retainer block 22 raised from the periphery opposite to the pivot pin 21. The retainer block 22 defines a locating groove 221. A lever 4 is provided having its middle part pivotably connected between the through holes 13 of the second pair of lugs 12 of the container body 1 by a pivot pin 3, and a hooked portion 41 at one end adapted to be forced into engagement with the locating groove 221 of the retainer block 22 to hold down the sealing cover 2 on the container body 1.

Figure 7:
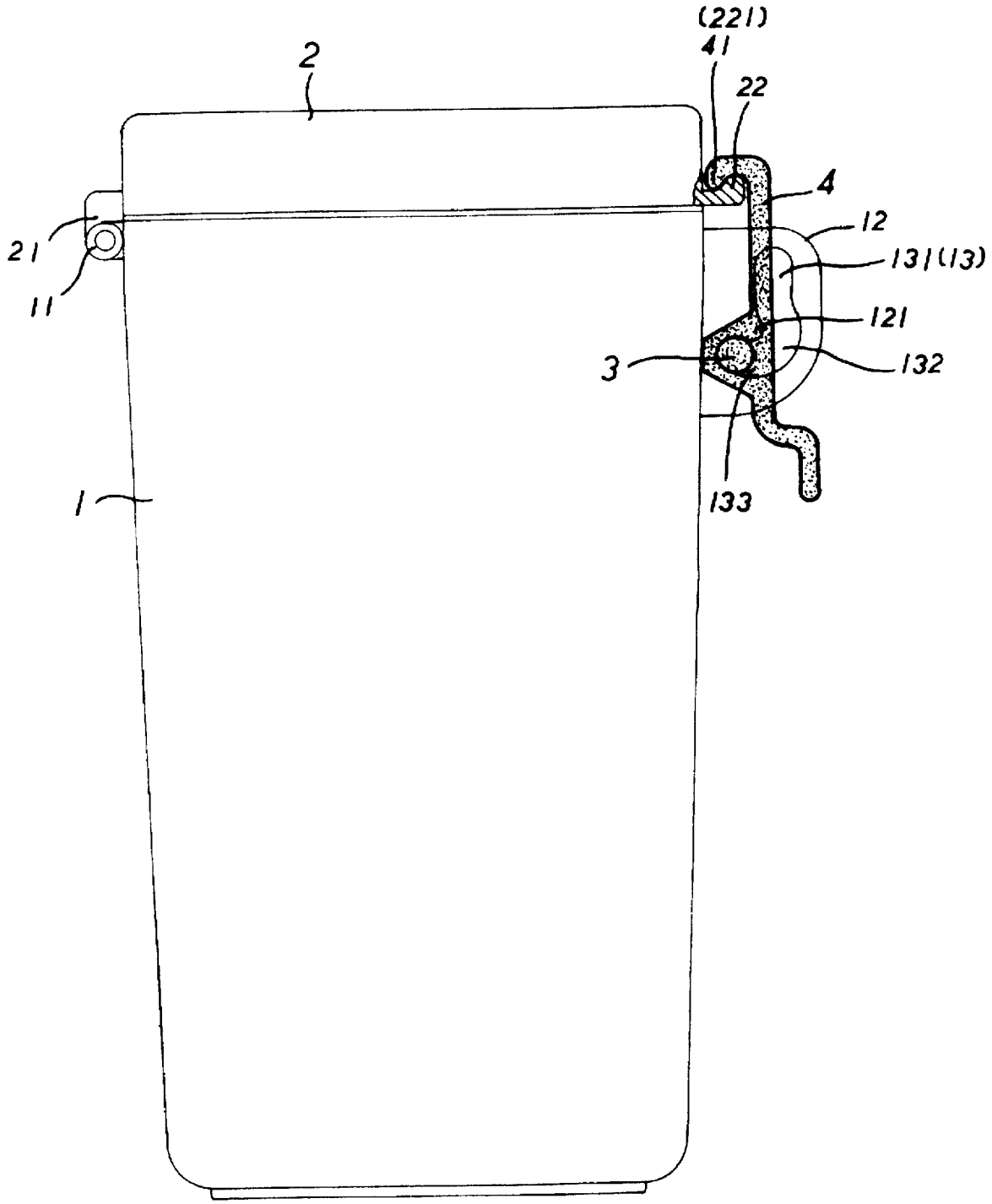
FIG. 7 is a side plain view of the present invention, showing the sealing cap locked.
Figure 8:
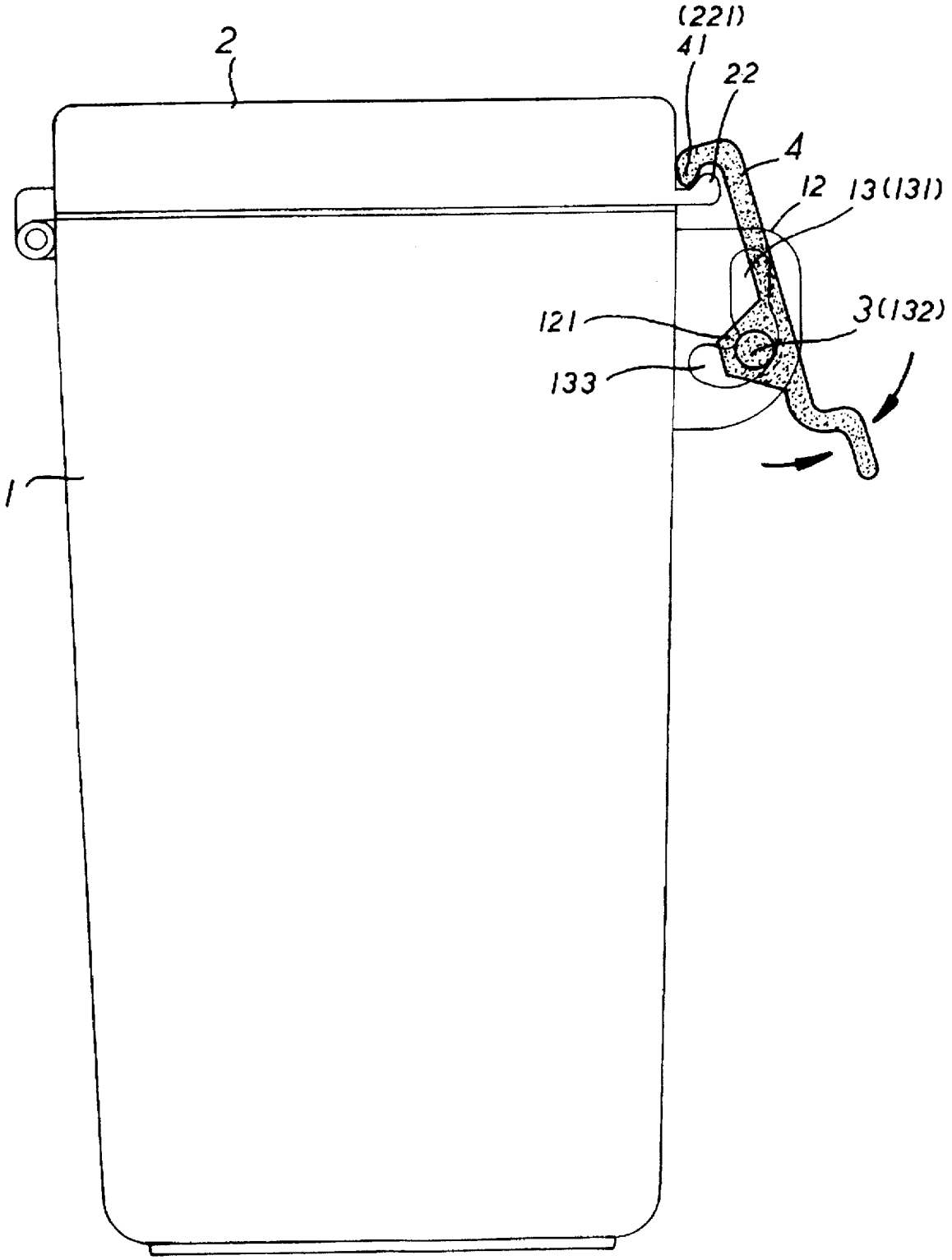
FIG. 8 is similar to FIG. 7 but showing the lever turned about the pivot pin.
Figure 9:
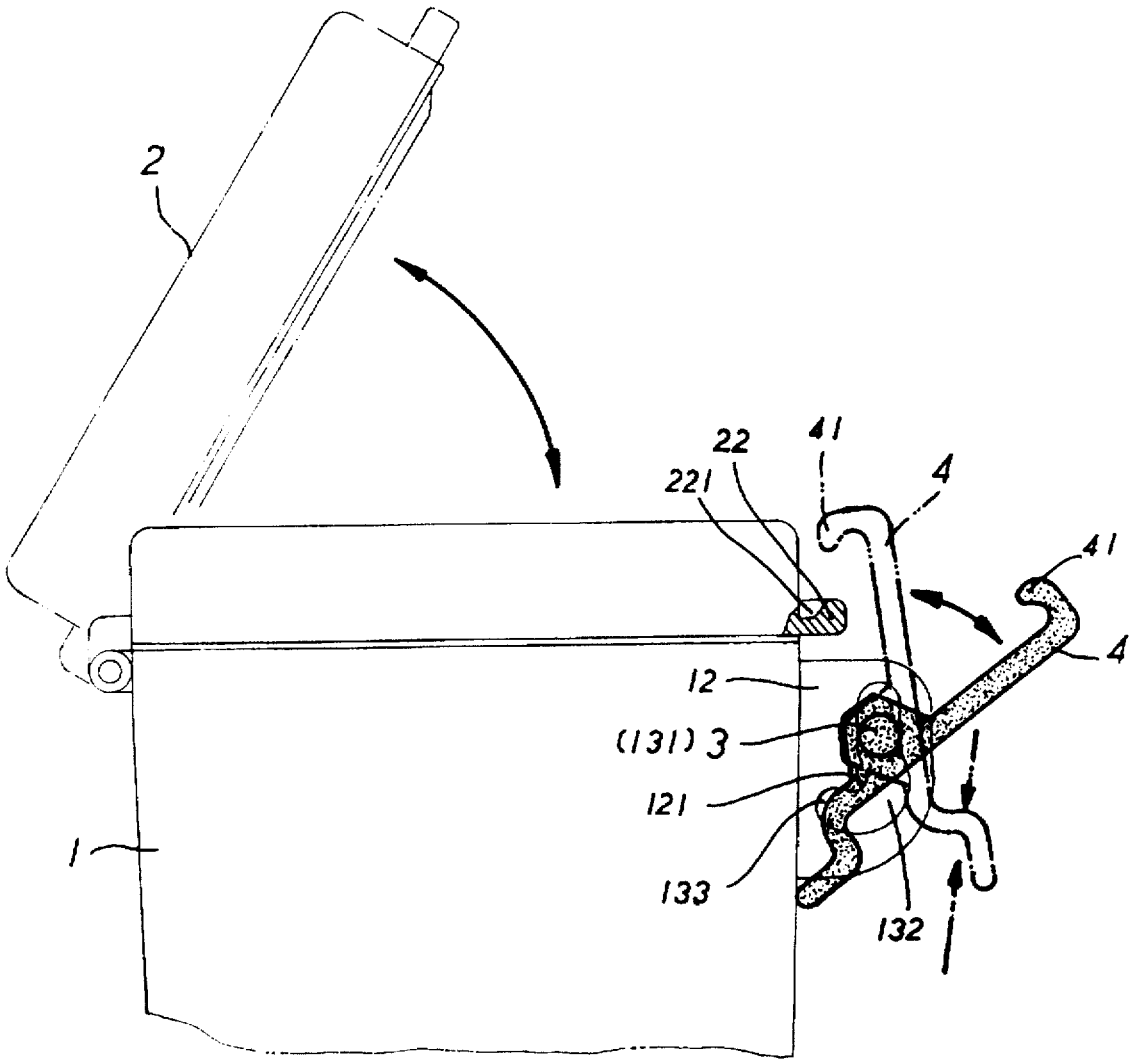
FIG. 9 is a schematic drawing of the present invention, showing the lever turned about the pivot pin and moved along the through holes of the second pair of lugs.

Referring to FIGS. 7, 8 and 9, when the sealing cap 2 is closed on the container body 1, the lever 4 is lifted to move the pivot pin 3 into the vertical sliding portion 131 of the through hole 13, then the lever 4 is turned inwards to force the hooked portion 41 into engagement with the locating groove 221 of the retainer block 22, and then the bottom end of the lever 4 is forced inwards to move the pivot pin 3 over the arched intermediate portion 132 and the projecting portion 121 toward the transverse retaining portion 133 (see FIG. 8). When the pivot pin 3 is moved into the transverse retaining portion 133, the lever 4 is closely attached to the periphery of the container body 1, and a downward pulling force is employed to the hooked portion 41, causing the hooked portion 41 and the retainer block 22 to be firmly retained together (see FIG. 7). When to unlock the sealing cap 2, the bottom end of the lever 4 is turned outwards to move the pivot pin 3 from the transverse retaining portion 133 over the arched intermediate portion 132 and the projecting portion 121 into the vertical sliding portion 131, and then the lever 4 is turned about the pivot pin 3 to disengage the hooked portion 41 from the locating groove 221 of the retainer block 12 (see FIGS. 8 and 9).

While only one embodiment of the present invention has been shown and described, it will be understood that various modifications and changes could be made there unto without departing from the spirit and scope of the invention disclosed.

What the invention claimed is:

1. A sealing container comprising:

a container body having a first pair of lugs and a second pair of lugs raised from the periphery at two opposite sides near its topmost edge;

a sealing cap pivoted to the first pair of lugs of said container body for sealing said container body, said sealing cap having a retainer block raised from the periphery corresponding to the second pair of lugs of said container body;

a pivot pin transversely coupled between the second pair of lugs of said container body; and a lever turned about said pivot pin and having a top end terminating in a hooked portion to be forced into engagement with the retainer block of said sealing cap to hold down said sealing cap on said container body;

wherein said second pair of lugs of said container body comprise each a through hole in which said pivot pin is moved, and a springy, smoothly curved projecting portion projecting into said through hole, the through hole of each of said second pair of lugs comprising a vertical sliding portion at the top, a transverse retaining portion at the bottom, and an arched intermediate portion communicating between said vertical sliding portion and said transverse retaining portion corresponding to said springy, smoothly curved projecting portion; said lever is allowed to be turned about said pivot pin to force its hooked portion into or out of engagement with said retainer block of sad sealing cap when said pivot pin is moved from said transverse retaining portion into said vertical sliding portion.

* * * * *